US006105769A

United States Patent [19]

Chen

[11] Patent Number: 6,105,769

[45] Date of Patent: Aug. 22, 2000

[54] TOOL BOX HAVING DRAWER FOR RECEIVING SMALL OBJECTS

[76] Inventor: Kuen Jen Chen, No. 6, Lane 609, Sec. 1, Chong San Road, Da Chia Town Taichung Hsien 437, Taiwan

[21] Appl. No.: 09/467,493

[22] Filed: Dec. 20, 1999

[51] Int. Cl.[7] ..... B65D 85/28

[52] U.S. Cl. ..... 206/373; 206/372; 312/902

[58] Field of Search ..... 206/349, 372–379, 206/315.11; 211/69, 70.6; 312/902, 348.3

[56] References Cited

U.S. PATENT DOCUMENTS

| | | | |
|---|---|---|---|
| 4,023,304 | 5/1977 | Singer | 312/902 |
| 4,303,158 | 12/1981 | Perkins | 206/373 |
| 5,114,007 | 5/1992 | Chen | 206/373 |
| 5,409,560 | 4/1995 | Hammer et al. | 206/373 |
| 5,788,072 | 8/1998 | Chen | 206/372 |
| 5,826,719 | 10/1998 | Chen | 206/373 |
| 5,857,757 | 1/1999 | Bieker et al. | 206/373 |
| 6,012,584 | 1/2000 | Dawson | 206/372 |

*Primary Examiner*—Paul T. Sewell
*Assistant Examiner*—Luan K. Bui
*Attorney, Agent, or Firm*—Charles E. Baxley

[57] ABSTRACT

A tool box includes a housing for receiving tool members and one or more drawers slidably received in a base of the housing for receiving small objects, such as the nuts, screws, bolts etc. A plate and a cover are secured to the front portion of the base for slidably receiving the drawers. The base and the plate and the cover include one or more guide channels for guiding the drawers to slide relative to the base, and include one or more protrusions for retaining the drawers in the base, and includes one or more stops for preventing the drawers from being disengaged from the cover.

8 Claims, 4 Drawing Sheets

TOOL BOX HAVING DRAWER FOR RECEIVING SMALL OBJECTS

BACKGROUND OF THE INVENTION

1. Field of the Invention

The present invention relates to a tool box, and more particularly to a tool box having one or more drawers for receiving small objects or fasteners.

2. Description of the Prior Art

Typical took boxes comprise a cover and a casing pivotally coupled together and having a number of recesses or cavities formed therein for receiving and holding the tool members. The typical tool boxes have no spaces for receiving the small objects, such as the screws, nuts, bolts, nails, etc.

In order to solve the problem, the present applicant has developed a tool box which is disclosed in U.S. Pat. No. 5,826,719 to Chen and which comprises a single drawer slidably receiving in the tool box for receiving the small objects.

The present invention has arisen to mitigate and/or obviate the afore-described disadvantages of the conventional tool boxes.

SUMMARY OF THE INVENTION

The primary objective of the present invention is to provide a tool box including one or more drawers slidably received in a base for receiving the small objects or fasteners.

In accordance with one aspect of the invention, there is provided a tool box comprising a housing for receiving tool members, the housing including a lower portion having a base provided therein, the base including a front portion and including at least one opening formed therein, a cover secured to the front position of the base and including at least one opening formed therein and aligned with the opening of the base, and at least one drawer slidably received in the opening of the cover and the opening of the base for receiving objects.

The base includes at least one channel formed therein, the cover includes at least one channel formed therein and aligned with the channel of the base, the drawer includes at least one projection slidably engaged in the channel of the cover and the channel of the base.

The cover includes a front portion having a stop extended therefrom and extended inward of the channel thereof for engaging with the projection of the drawer and for preventing the drawer from being disengaged from the cover.

The base includes a rear portion having at least one protrusion extended therefrom and extended inward of the channel thereof for engaging with the projection of the drawer and for retaining the drawer in the base and the cover.

A plate is further secured between the base and the cover, the plate includes at least one opening formed therein for slidably receiving the drawer and includes at least one channel formed therein and aligned with the channel of the base and the channel of the cover for slidably receiving the projection of the drawer.

A securing means is further provided for securing the cover to the base. One or more door panels are further pivotally secured to the housing for retaining the tool members within the housing. The drawer has a hand grip provided thereon.

Further objectives and advantages of the present invention will become apparent from a careful reading of a detailed description provided hereinbelow, with appropriate reference to accompanying drawings.

DETAILS DESCRIPTION OF THE PREFERRED EMBODIMENT

Figure 1:
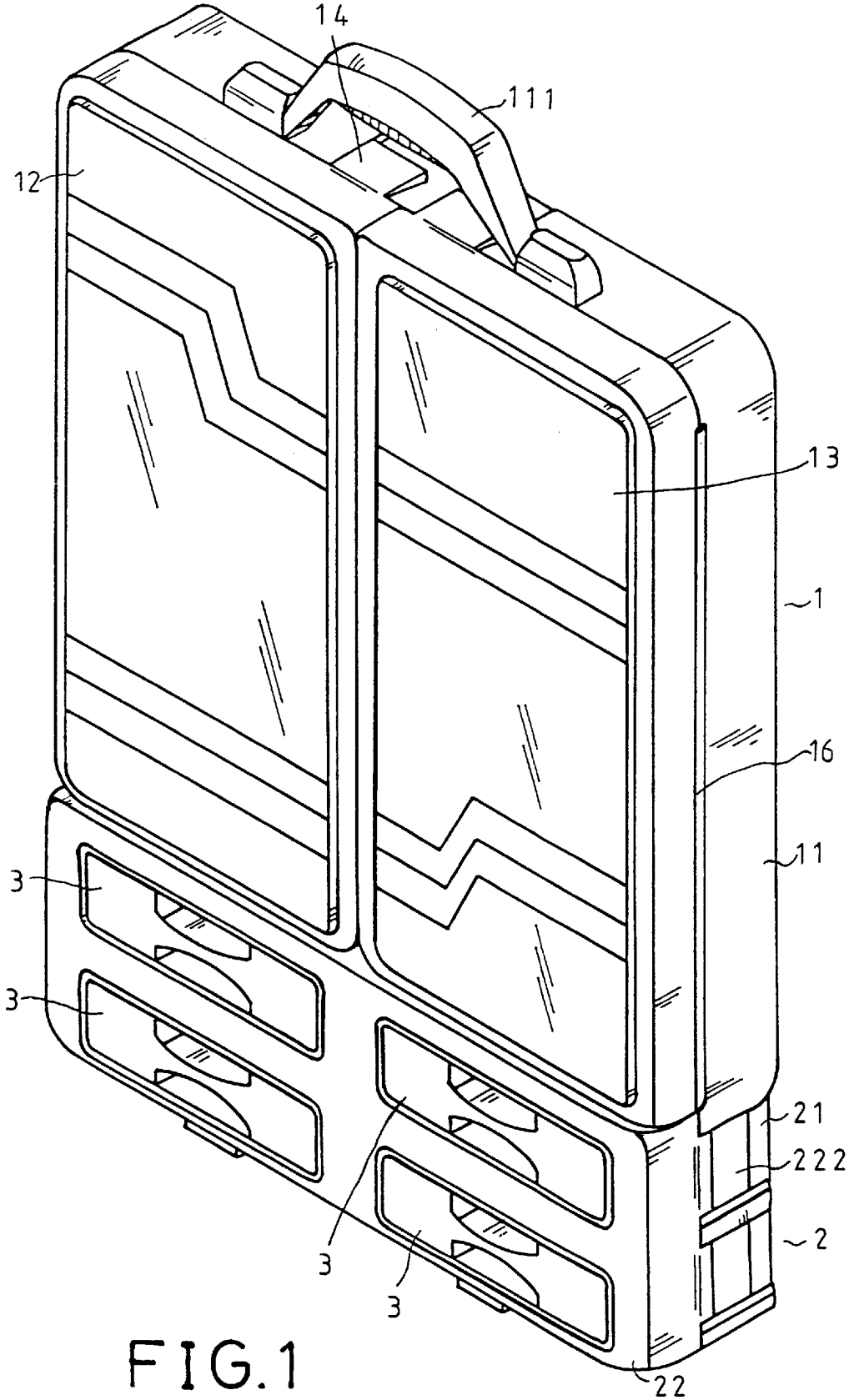
FIG. 1 is a perspective view of a tool box in accordance with the present invention.
Figure 2:
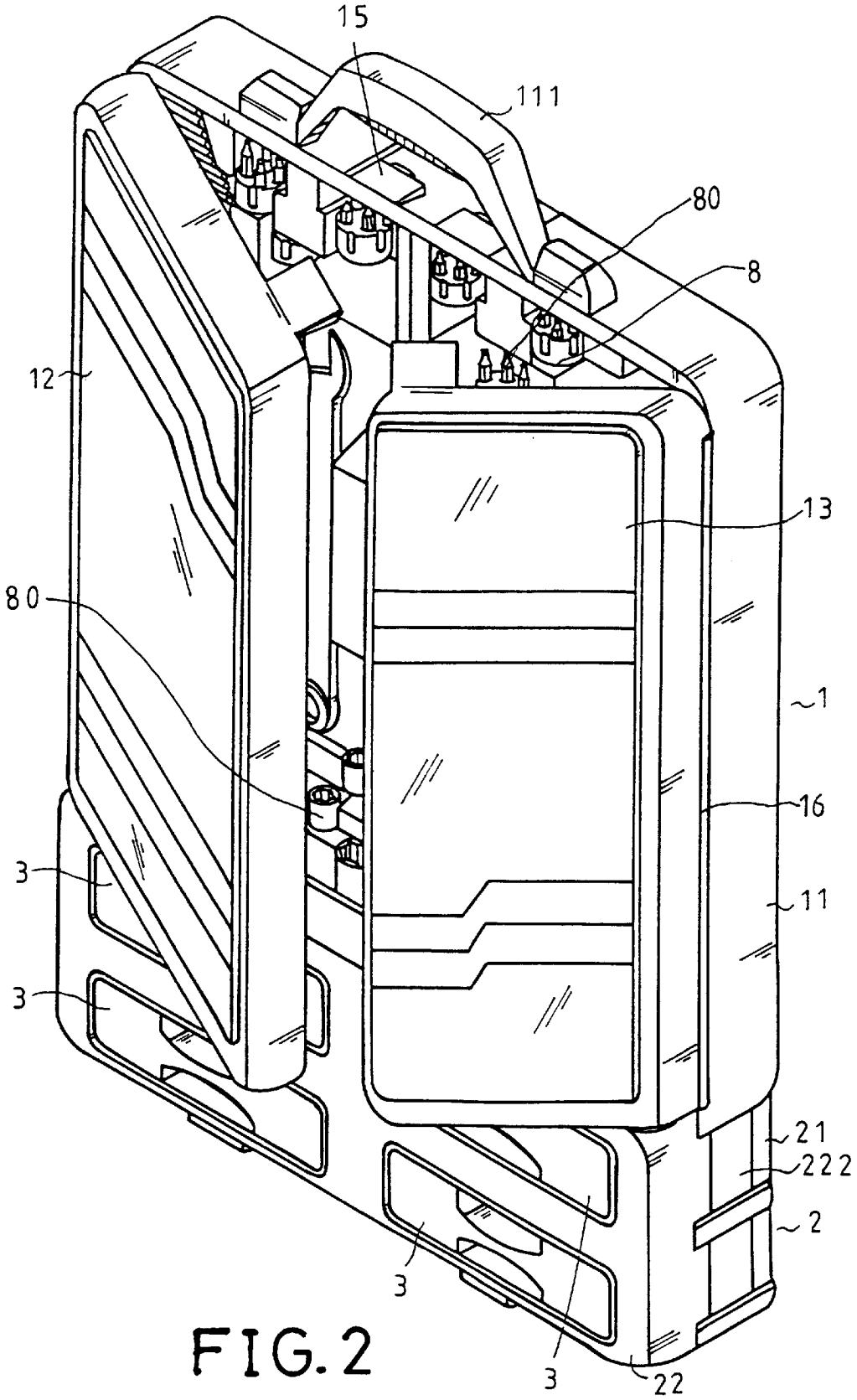
FIG. 2 is a perspective view of the tool box, in which the doors are slightly opened for showing the inner structure of the tool box.

Referring to the drawings, and initially to FIGS. 1 and 2, a tool box 1 in accordance with the present invention comprises a housing 11 disposed on a base 2 and having one or more door panels 12, 13 pivotally coupled thereto at hinge lines 16. The housing 11 and/or the door panels 12, 13 each includes one or more cavities 8 formed therein for receiving tool members 80, such as the tool bits or sockets or pliers or the other tools therein. The door panels 12, 13 are rotatable relative to the housing 11 such that the door panels 12, 13 may be rotated away from the housing 11 (FIG. 2) for obtaining or disposing the tool members 80 into the housing 11, and such that the door panels 12, 13 may be rotated toward the housing 11 (FIG. 1) to retain the tool members 80 in the housing 11. The housing 11 includes a handle 111 for carrying purposes. The door panels 12, 13 each includes one or more latches 14 provided thereon for engaging with the latch members 15 of the housing 11 and for securing the door panels 12, 13 to the housing 11. The tool box 1 may be made by blow molded processes or by the other molding processes.

Figure 3:
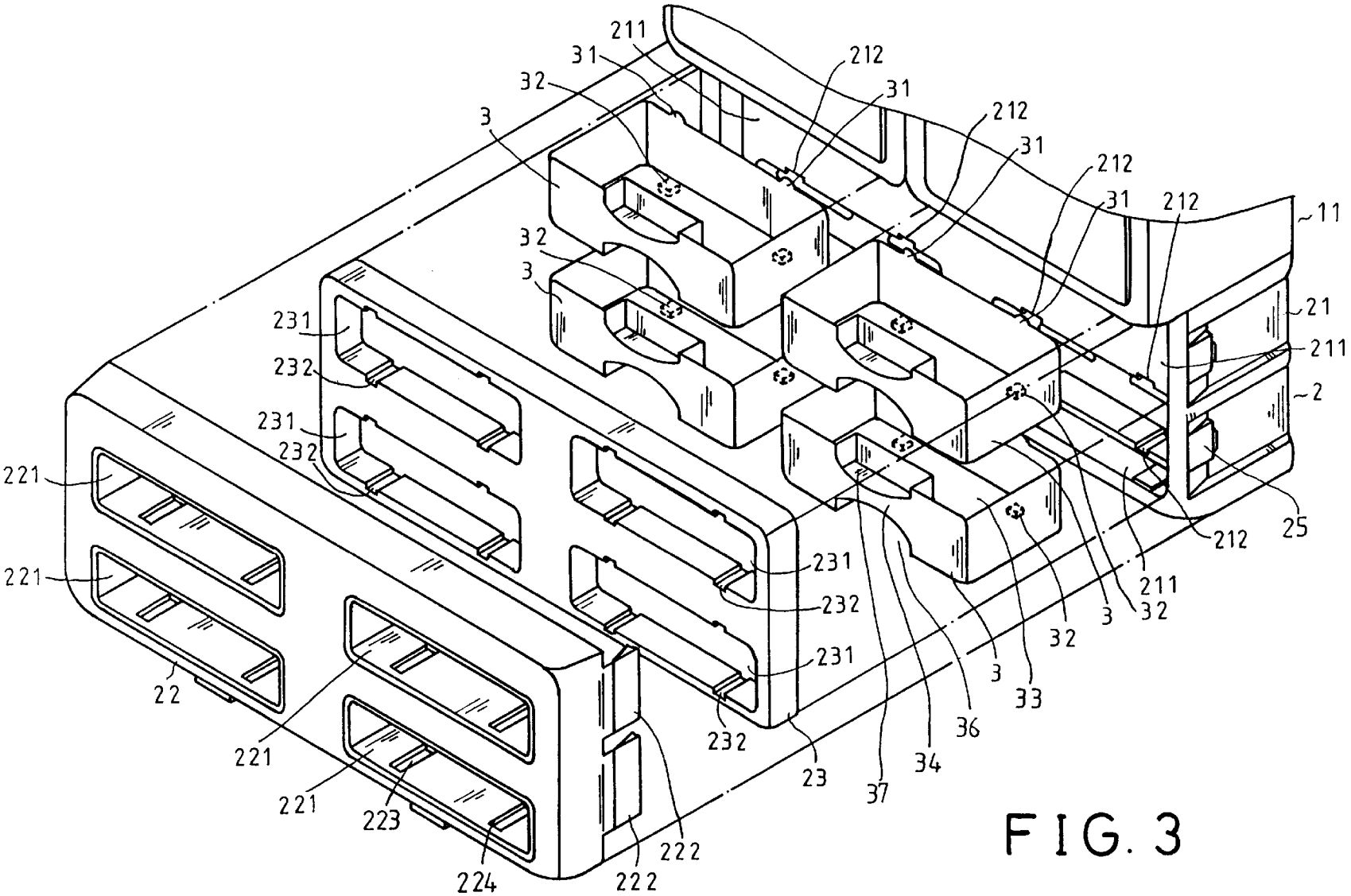
FIG. 3 is a partial exploded view illustrating the drawers of the tool box.
Figure 4:
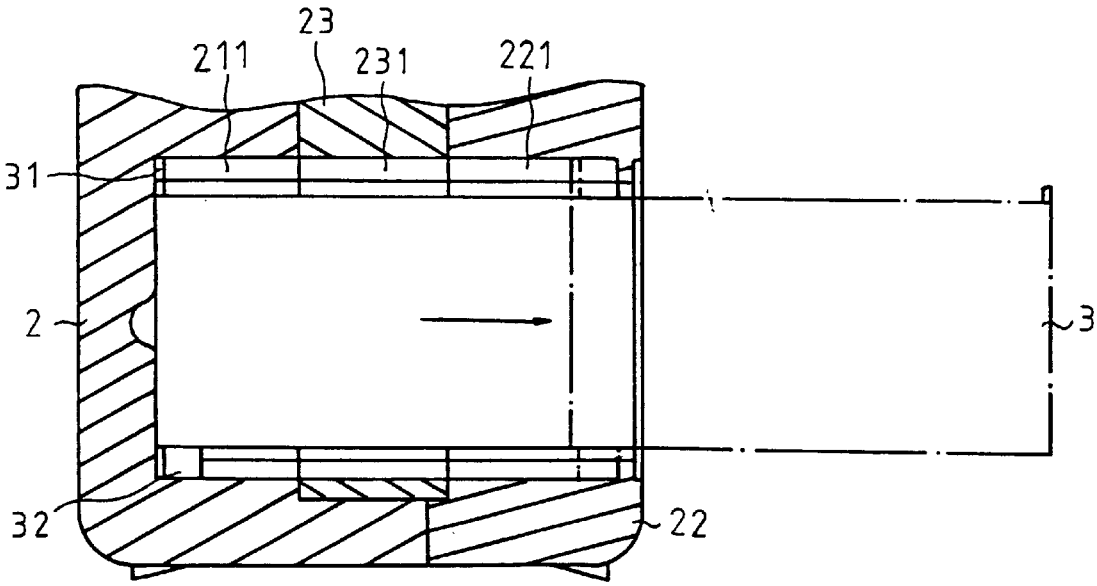
FIG. 4 is a partial cross sectional view showing the operation of the drawer.
Figure 5:
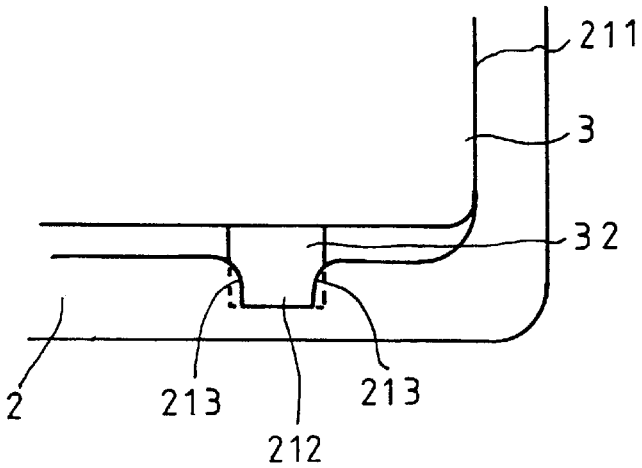
FIG. 5 is a schematic view illustrating the stop for the drawers.

As shown in FIGS. 3–5, the base 2 may be in the form of a casing 21 and includes one or more openings 211 formed therein. A cover 22 includes one or more latches 222 extended therefrom for engaging with the latch members 25 of the base 2 and for securing the cover 22 to the front portion of the base 2. The cover 22 also includes one ore more openings 221 formed therein and aligned with the openings 211 of the base 2. A plate 23 may be selectively provided and secured between the cover 22 and the base 2 by the cover 22. The plate 23 also includes one or more openings 231 formed therein and aligned with the openings 211, 221 of the base 2 and of the cover 22 for each slidably receiving a drawer 3 therein. The base 2 and the plate 23 and the cover 22 each includes one or more channels 212, 232, 223 formed therein, and preferably formed in the inner peripheral portion thereof and aligned with each other. The drawers 3 each includes one or more projections 31, 32 extended therefrom and slidably engaged in the respective channels 212, 232, 223 of the base 2 and the plate 23 and the cover 22 for guiding the drawers 3 to move inward and outward of the base 2 and the plate 23 and the cover 22. The drawers 3 each includes a chamber 33 formed therein for receiving the small objects, such as the nails, the nuts, the screws, the bolts, etc.

As best shown in FIG. 3, the cover 22 includes a stop 224 formed in front of each of the channels 223 thereof for engaging with the projections 31, 32 of the drawers 3 and for preventing the drawers 3 from being disengaged from the base 2 and the cover 22. As shown in FIG. 5, the base 2 includes one or more protrusions 213 extended inward of one or more of the channels 212 of the base for engaging with the projections 31 or 32 of the drawers 3 and for retaining the drawers 3 within the base 2 and the cover 22. The drawers 3 each includes a hand grip 34 formed in the front portion thereof and defined by and between a lower recess 36 and an upper recess 37.

In operation, the tool members 80 of a greater size may be received and stored in the housing 11. The small objects, such as the nails, the nuts, the screws, the bolts, etc., may be separately received in the drawers 3 such that the small objects may be easily obtained by the users.

Accordingly, the tool box in accordance with the present invention includes one or more drawers slidably received in the base of the housing for receiving the small objects or fasteners.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool box comprising:

a housing for receiving tool members, said housing including a lower portion having a base provided therein, said base including a front portion and including at least one opening formed therein, a cover secured to said front portion of said base and including at least one opening formed therein and aligned with said at least one opening said base, and at least one drawer slidably received in said at least one opening of said cover and said at least one opening of said base for receiving objects, wherein said base includes at least one channel formed therein, said cover includes at least one channel formed therein and aligned with said at least one channel of said base, said at least one drawer includes at least one projection slidably engaged in said at least one channel of said cover and said at least one channel of said base.

2. The tool box according to claim 1, wherein said cover includes a front portion having a stop extended therefrom and extended inward of said at least one channel thereof for engaging with said at least one projection of said at least one drawer and for preventing said at least one drawer from being disengaged from said cover.

3. The tool box according to claim 1, wherein said base includes a rear portion having at least one protrusion extended therefrom and extended inward of said at least one channel thereof for engaging with said at least one projection of said at least one drawer and the retaining said at least one drawer in said base and said cover.

4. The tool box according to claim 1 further comprising a plate secured between said base and said cover, said plate includes at least one opening formed therein for slidably receiving said at least one drawer and includes at least one channel formed therein and aligned with said at least one channel of said base and said at least one channel of said cover for slidably receiving said at least one projection of said at least one drawer.

5. A tool box comprising:

a housing for receiving tool members, said housing including a lower portion having a base provided therein, said base including a front portion and including at least one opening formed therein, a cover secured to said front portion of said base and including at least one opening formed therein and aligned with said at least one opening of said base, at least one drawer slidably received in said at least one opening of said cover and said at least one opening of said base for receiving objects, and a plate secured between said base and said cover.

6. The tool box according to claim 5 further comprising means for securing said cover to said base.

7. The tool box according to claim 5 further comprising at least one door panel pivotally secured to said housing.

8. The tool box according to claim 5, wherein said at least one drawer has a hand grip provided thereon.

* * * * *